US009005408B2

(12) United States Patent
Jin et al.

(10) Patent No.: US 9,005,408 B2
(45) Date of Patent: Apr. 14, 2015

(54) METHOD AND APPARATUS FOR EXTRACTING NOBLE METALS FROM INORGANIC GRANULAR WASTE CATALYSTS

(75) Inventors: In-Soo Jin, Eumseong-gun (KR); Vladimir Tychinin, Eumseong-gun (KR)

(73) Assignee: In-Soo Jin, Chungcheongbuk-Do (KR)

( * ) Notice: Subject to any disclaimer, the term of this patent is extended or adjusted under 35 U.S.C. 154(b) by 94 days.

(21) Appl. No.: 12/937,989

(22) PCT Filed: May 20, 2010

(86) PCT No.: PCT/KR2010/003174
§ 371 (c)(1),
(2), (4) Date: Oct. 14, 2010

(87) PCT Pub. No.: WO2011/145760
PCT Pub. Date: Nov. 24, 2011

(65) Prior Publication Data

US 2011/0284371 A1 Nov. 24, 2011

(51) Int. Cl.
*C25C 7/00* (2006.01)
*C25C 1/20* (2006.01)

(52) U.S. Cl.
CPC .. *C25C 1/20* (2013.01); *C25C 7/002* (2013.01)

(58) Field of Classification Search
CPC ..... C25C 1/20; C25C 7/002; C25C 5/02; C02F 1/46114
USPC ..... 204/237–239; 205/348, 349, 561, 205/565–570, 656–570
See application file for complete search history.

(56) References Cited

U.S. PATENT DOCUMENTS 3,915,822 A * 10/1975 Veltman ..... 210/665
3,969,201 A * 7/1976 Oloman et al. ..... 205/348

(Continued)

FOREIGN PATENT DOCUMENTS

EP 84309163.8 A2 12/1984
JP 08-225979 9/1996
JP 2004-162149 6/2004
KR 89-002751 B1 7/1989
KR 1020060111811 * 5/2008 ..... B01J 38/68

(Continued)

OTHER PUBLICATIONS

International Search Report for PCT/KR2010/003174 dated Feb. 17, 2011, 4 pages.

*Primary Examiner* — Harry D Wilkins, III
*Assistant Examiner* — Ciel Thomas
(74) *Attorney, Agent, or Firm* — Henry D. Coleman; R. Neil Sudol

(57) ABSTRACT

The leaching and precipitation of noble metals when circulating an electrolyte through a vertical cylindrical electrolytic cell comprising a fixed granular catalyst bed and a three-dimensional cathode filled with activated carbon granules are performed in the same step. Because the electrochemical leaching process and the electrochemical sorption process are performed simultaneously, the consumption of electric energy is reduced and the use of equipment becomes easy. An apparatus for extracting noble metals from inorganic granular waste catalysts comprises a vertical type electrolytic cell, conduit lines, an electrolyte circulating pump, a unit for automatically maintaining the required acidity of the electrolyte being circulated, a filter for filtering activated carbon particles from the electrolyte, control valves, and stop valves. The electrolytic cell comprises a heat exchanger for heating the electrolyte being circulated, an insoluble anode and a three-dimensional cathode filled with activated carbon granules.

28 Claims, 3 Drawing Sheets

(56) References Cited

U.S. PATENT DOCUMENTS

| | | | | | |
|---|---|---|---|---|---|
| 3,988,221 | A | * | 10/1976 | Garrett et al. | 205/348 |
| 4,240,886 | A | * | 12/1980 | Hodges et al. | 205/348 |
| 4,569,729 | A | * | 2/1986 | Goto et al. | 205/144 |
| 4,775,452 | A | * | 10/1988 | Kuninaga et al. | 205/348 |
| 5,756,874 | A | * | 5/1998 | Steward | 588/302 |
| 2004/0251199 | A1 | * | 12/2004 | Benavides | 210/634 |
| 2010/0065436 | A1 | * | 3/2010 | Jin | 205/342 |

FOREIGN PATENT DOCUMENTS

| | | | |
|---|---|---|---|
| KR | 1020080043149 | A | 5/2008 |
| KR | 2010-0058179 | A | 6/2010 |
| RU | 2119964 | C1 | 10/1998 |
| RU | 2198947 | C2 | 2/2003 |
| WO | 01/51685 | A2 | 6/2001 |
| WO | 2008/060038 | A1 | 5/2008 |

* cited by examiner

METHOD AND APPARATUS FOR EXTRACTING NOBLE METALS FROM INORGANIC GRANULAR WASTE CATALYSTS

BACKGROUND OF THE INVENTION

1. Field of the Invention

The present invention relates to electrochemical hydrometallurgy for reducing noble metal waste, and more particularly to a method and apparatus for extracting noble metals from inorganic granular waste catalysts.

2. Description of Related Art

A method for extracting noble metals from inorganic granular waste catalysts means a method comprising: electrochemically leaching noble metals in an electrolytic cell; precipitating the noble metals in a cathode; and then separating the noble metals from the cathode.

In a prior method for dissolving and extracting noble metals from waste catalysts [Prior-Art Document 1: U.S. Pat. No. 4,775,452, 1988, "Process for dissolution and recovery of noble metals"], leaching is carried out in the anode chamber of a horizontal type electrolytic cell. The horizontal type electrolytic cell comprises a fluorine resin-based anion exchange membrane that separates the electrolytic cell into two chambers, anode and cathode chambers. The bottom of the anode chamber comprises a diffusion lattice. In the first step of extracting noble metals, a granular waste catalyst fixed bed is introduced into the anode chamber, and an electrolyte is circulated upward through the diffusion lattice. As the electrolyte, hydrochloric acid, nitric acid, sulfuric acid or an acidic compound is used. Preferably, a 5-35% hydrochloric acid is used. Herein, the anode and cathode membranes are positioned along the side of the electrolytic cell in parallel with the flow direction of the electrolyte.

The porous anode of stable size is made of titanium coated with noble metal oxide. The cathode is made of titanium. The electrolytic cell is 85 mm in length, 115-250 mm in width and 200-1000 mm in depth. In the second step after leaching noble metals, the electrolyte is 6-50-fold diluted and the noble metals are precipitated, whereby the noble metals are separated to activated carbon granules present in a fluidized state in the cathode space of a second electrolytic cell including a cationic membrane.

The disadvantage of this extraction method is that the efficiency for extracting noble metals decreases as the distance between the anode and the cathode increases. This is because hydrochloric oxide moves upward in parallel with the anode membrane by the electrolyte flow and its concentration decreases as it goes away from the surface of the anode membrane toward the cathode. For this reason, the leaching of novel noble metals is mainly performed in the anode bed close to waste catalysts.

Because the electrolyte is pumped once through the electrolytic cell, a large amount of solution flows out, such that additional equipment is required, thus increasing economic losses.

The apparatus that is used to realize the extraction method according to Prior-Art Document 1 is energy-intensive, has low efficiency in extracting noble metals and requires the use of high-concentration (5-35%) acid (mainly hydrochloric acid).

A prior art for extracting noble metals from inorganic waste catalysts, sludge, ore concentrates and other metals [Prior-Art Document 2: Russia Patent No. 21199646, 1997, "Method for extracting noble metals and apparatus for carrying out the same"] has a characteristic in that the leaching of noble metals and the precipitation of a filled cathode during the circulation of an electrolyte through a fixed filter bed or fluidized bed of leached particles are carried out simultaneously in the same step.

The extraction of noble metals is carried out simultaneously through an electrolyte cell including a leaching block and a filled cathode. A 10-25% sodium chloride aqueous solution containing a required amount of hydrochloric acid and alkali is used as an electrolyte. Herein, noble metals are deposited on the filled cathode. The leaching block comprises one or several reactors which are provided with conventional units for introducing and discharging a leaching material. The leaching block includes an electrolyte cell provided with a pH-measuring chamber and an automatic discharge control unit.

After noble metals have been deposited, the filled cathode is separated from the electrolytic cell and sent to a recycling process. For metal extraction, the filled cathode is incinerated. Metal extraction may also be performed without separating the cathode from the electrolytic cell. In this case, noble metals are dissolved by passing an electric current of opposite polarity through the cathode, thus obtaining a high-concentration chloride solution.

The disadvantages of the method according to Prior-Art Document 2 are that the leaching process is complicated and the functional technical blocks are separated from each other to make the design of the apparatus difficult.

The prior art for extracting noble metals from inorganic waste catalysts, ore concentrates and other metals [Prior-Art Document 3: Russia Patent No. 21989477, Sep. 12, 2000, "Method for extracting noble metals"] is technically closest to the present invention and comprises carrying out leaching in an electrolyte, circulating the electrolyte along a closed circuit through a filling material, precipitating metals in an electrolytic cell, and then separating noble metals from a cathode according to a conventional method, wherein the metals treated in the filled form are placed in the space between the electrodes of the electrolytic cell. The electrochemical leaching of noble metals can be activated by previously developing the polarity reversal of the electrodes. For this purpose, the electrodes are changed into a large-capacity multipolar electrode which allows the anode dissolution of metals regardless of the amount of material. Meanwhile, by inhibiting the formation of a brown cloud in the cathode, hydrated anionic chloride compounds of noble metals which are formed in a process of leaching the filling material are prevented from being burned out destroyed by a fire with the cathode, and the electrolyte is circulated from the anode to the cathode at a rate suitable for such conditions. Herein, acidic water containing 0.3-4.0% hydrochloric acid is used as the electrolyte.

In order to study the efficiency of said noble metal extraction method and examine the disadvantages thereof, the present inventors constructed an electrolytic cell (FIG. 1) corresponding to the description of Prior-Art Document [3]. As described in Prior-Art Document [3], the electrolytic cell has a horizontal structure, the effective cross-sectional area of the electrolytic cell is 1600 $cm^2$ (40 cm×40 cm), and the length of the filling material is 100 cm. The filling material in the space between the electrodes is fixed with a dielectric lattice. The parameters of the experiment are consistent with those described in Prior-Art Document [3].

According to a study conducted by the present inventors using said prototype, the influence of polarity reversal on the rate and depth of leaching was insignificant. The leaching time increased by the time during which the polarity was developed. Also, noble metals were not formed as a compact foil on the surface of the titanium cathode and were precipitated in the form of niello which was easily separated from the cathode surface by rising hydrogen bubbles. Hydrogen bubbles separated from the surface of the cathode membrane rose to the surface of the electrolyte and formed convection current. As a result, the noble metal niello in a fluidized-bed state was placed in the cathode space of the electrolytic cell. Such conditions make the noble metal niello returning to the filling material of the waste catalyst through the lattice holes. In addition, the noble metal niello moves to the anode space of the electrolytic cell by the electrolyte flow being circulated. The filling material sample was analyzed after conducting the experiment, and as a result, it could be seen that the leaching of noble metals at the bottom of the filler was incomplete. This is because the rate of circulation of the electrolyte from the anode to the cathode is not constant along the cross section of the electrolytic cell. The electrolyte circulation rate is slower in the lower portion of the electrolytic cell than in the upper portion. This can be clearly explained because the waste catalyst particles of the lower portion of the electrolytic cell are under the pressure of the particles of the upper portion. This reduces the size of the free space in which the electrolyte circulation between the particles of the lower portion of the electrolytic cell occurs. Such conditions impose limitations on increasing the depth of the electrolytic cell in order to use the electrolytic cell in industrial applications. In addition, the area of the electrolytic cell in which the electrolyte evaporates is large. If the above-described process is carried out at 70° C., anode hydrochloric acid oxide actively evaporates, and thus additional means for reducing negative effects on the environment are required. Also, the acidity of the solution decreases, because hydrochloric acid is used to partially dissolve catalysts in the electrolytic process. It was found that, when the acidity (pH) of the solution was more than 1, the rate of leaching significantly decreased.

In order to maintain acidity at a constant level, it is required to periodically discharge the electrolyte from the electrolytic cell and to supplement hydrochloric acid to a required concentration.

PRIOR-ART DOCUMENTS

1. U.S. Pat. No. 4,775,452, 1988, "Process for dissolution and recovery of noble metals"

2. RU Patent No. 2119964, 1997, Method for extracting noble metals and apparatus for carrying out the same"

3. RU Patent No. 21989477, Sep. 12, 2000, "Method for extracting noble metals"

BRIEF SUMMARY OF THE INVENTION

It is an object of the present invention to develop a an effective method for extracting noble metals from granular waste catalysts by leaching and construct an apparatus which is easily used to realize this method.

This object is accomplished by the inventive method for extracting noble metals from inorganic granular waste catalysts and other materials, which includes leaching noble metals in the space between the electrodes of a vertical electrolytic cell. The leaching is performed by an electrolyte which circulates upward from the anode to the cathode along a closed circuit. The precipitation of noble metals is performed in a three-dimensional cathode filled with activated carbon granules. Unlike the prototype, a hydrochloric acid having an acidity (pH) of 1 is used as the electrolyte and contains 0.1-5% aluminum chloride ($AlCl_3$). The leaching of noble metals and the precipitation thereof in the three-dimensional filled cathode are performed simultaneously in the same step. The noble metals are separated from the cathode by incinerating the activated carbon or dissolving the precipitated metals in the anode.

The electrolytic cell according to the present invention allows waste catalysts to be electrolyzed in a granular form without being powdered. The present invention can greatly improve the yield of extraction of platinum-group metals from metal compound-supported granular catalysts to extract almost all the amount of the metals, reduces electricity consumption and extraction time, and has improved ecological compatibility. Also, the present invention has improved working efficiency, because it can minimize the amount of liquid waste to be recycled and allows a large amount of waste catalysts to be introduced and leached. In addition, the reliability and electrical safety of the electrolytic cell can be increased and the repair and maintenance of the electrolytic cell is simple and convenient.

BRIEF DESCRIPTION OF THE SEVERAL VIEWS OF THE DRAWING(S)

DETAILED DESCRIPTION OF THE INVENTION

Figure 1:
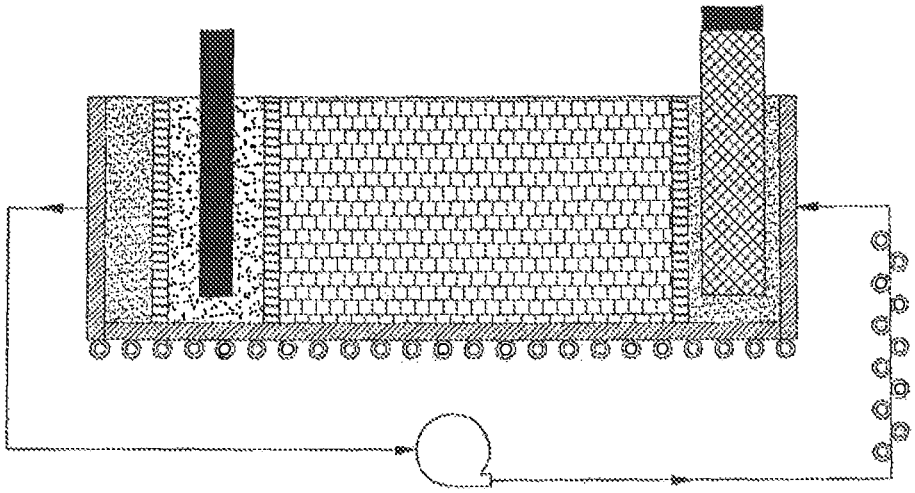
PRIOR ART FIGURE 1
FIG. 1 is a cross-sectional view of an electrolytic cell according to the prior art.
Figure 2:
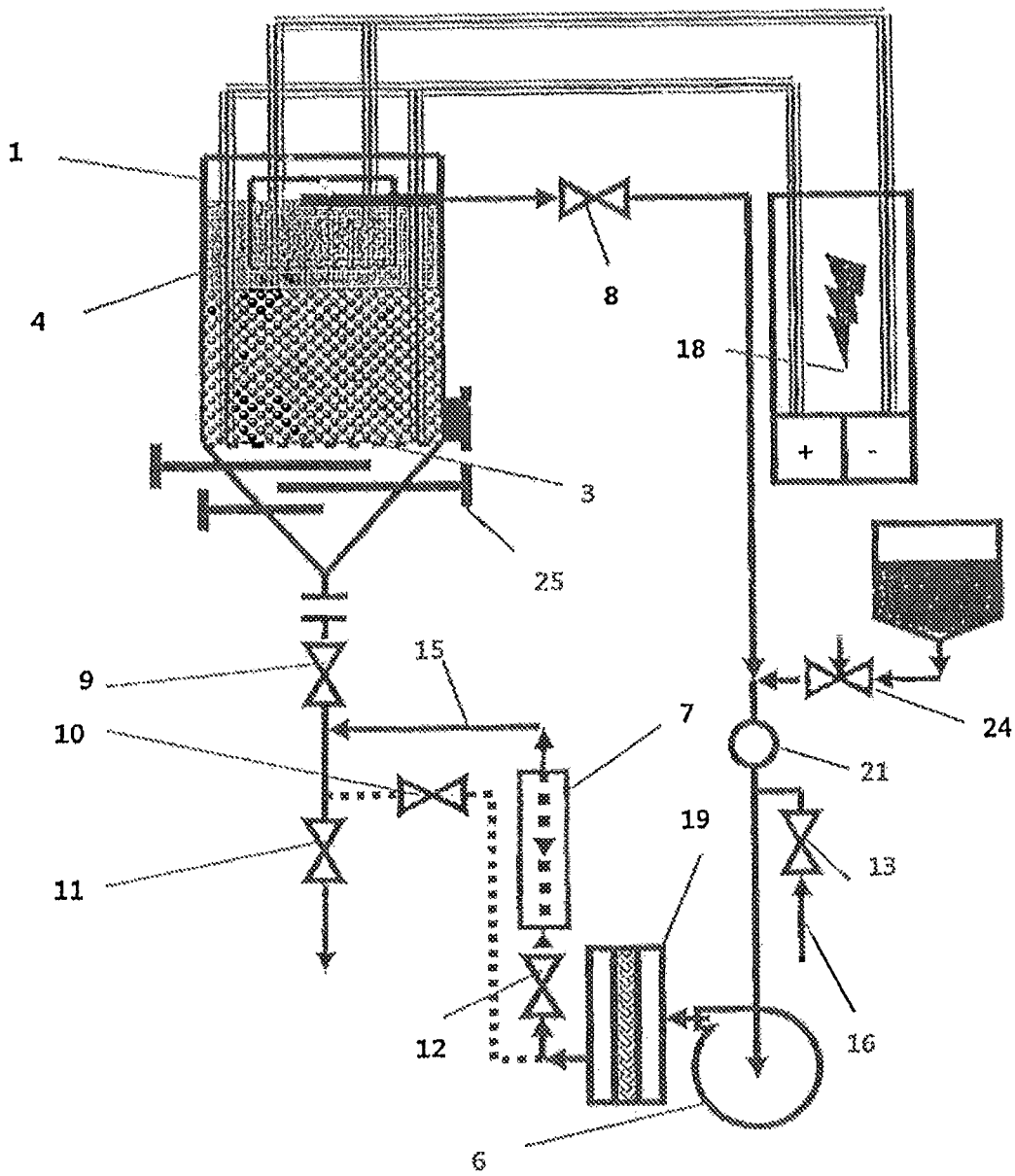
FIG. 2 is a cross-sectional view of an apparatus for extracting noble metals according to the present invention.

In the present invention, an apparatus (FIG. 2) for extracting noble metals from inorganic granular catalysts and other materials has a vertical flow electrolytic cell 1 including an insoluble anode 3 and a three-dimensional filled cathode 4. Charging of the vertical flow electrolytic cell is performed using a charging block 18. The anode and cathode spaces are connected with conduit lines. An electrolyte is circulated by a pump 6 which operates at a predetermined speed which is controlled by a flow meter 7. In order to prevent activated carbon powder from penetrating from the three-dimensional filled cathode into the anode space, a filter-press 19 is placed in a circulation line. The acidity of a solution in the circulation line is measured by a pH meter 21 and maintained at a constant level by an automatic hydrochloric acid discharge controller 24. The apparatus also includes stop valves 8, 9, 10, 11, 12 and 13.

The apparatus for extracting noble metals operates in the following manner.

The vertical flow electrolytic cell is filled with granular waste catalysts from which organic mixtures have been removed. Noble metals contained in the catalysts in an amount of 0.05-5% should be in a regenerated (metal) state. Corks (valves) 10 and 13 are opened, valves 8, 11 and 12 are closed, and the automatic discharge controller 24 is off, and in this state, an electrolyte consisting of a hydrochloric acid solution having a pH of 1 and 0.1-5% aluminum chloride ($AlCl_3$) is fed into the electrolytic cell through an inlet 16. The electrolyte is fed along a high-speed electrolyte pumping line 15. After feeding the electrolyte into the apparatus, the electrolyte is heated by a tube heater 25. As the electrolyte reaches a predetermined temperature, the valve 10 is closed and the valve 12 is opened. At this time, the electrolyte circulates through the flow meter 7 at a predetermined speed. The charging block 18 is used to set the current value of the electrolytic cell. Hydrochloric acid of amount required to maintain the acidity of the electrolyte at a pH of 1 is discharged by the automatic charge controller 24 to the space in the front of the anode of the vertical electrolytic cell. Conditions set for performing this process can be maintained using a conventional automatic control system. After a sufficient amount of extracted noble metals have been precipitated in the three-dimensional filled cathode 4, the cathode is disassembled from the vertical electrolytic cell and incinerated. In the case in which the precipitated noble metals are dissolved in the anode, the process is stopped, the electrolyte is poured out of the electrolytic cell, and the filled cathode is detached and washed with hot water. After washing, the cathode is placed in a tube containing a titanium electrode, the tube is filled with hydrochloric acid or nitric acid, and then anode polarity is applied to the three-dimensional carbon electrode supported with noble metals. In the process in which the polarity is changed, the metals deposited on the activated carbon granules are gradually dissolved.

Figure 3:
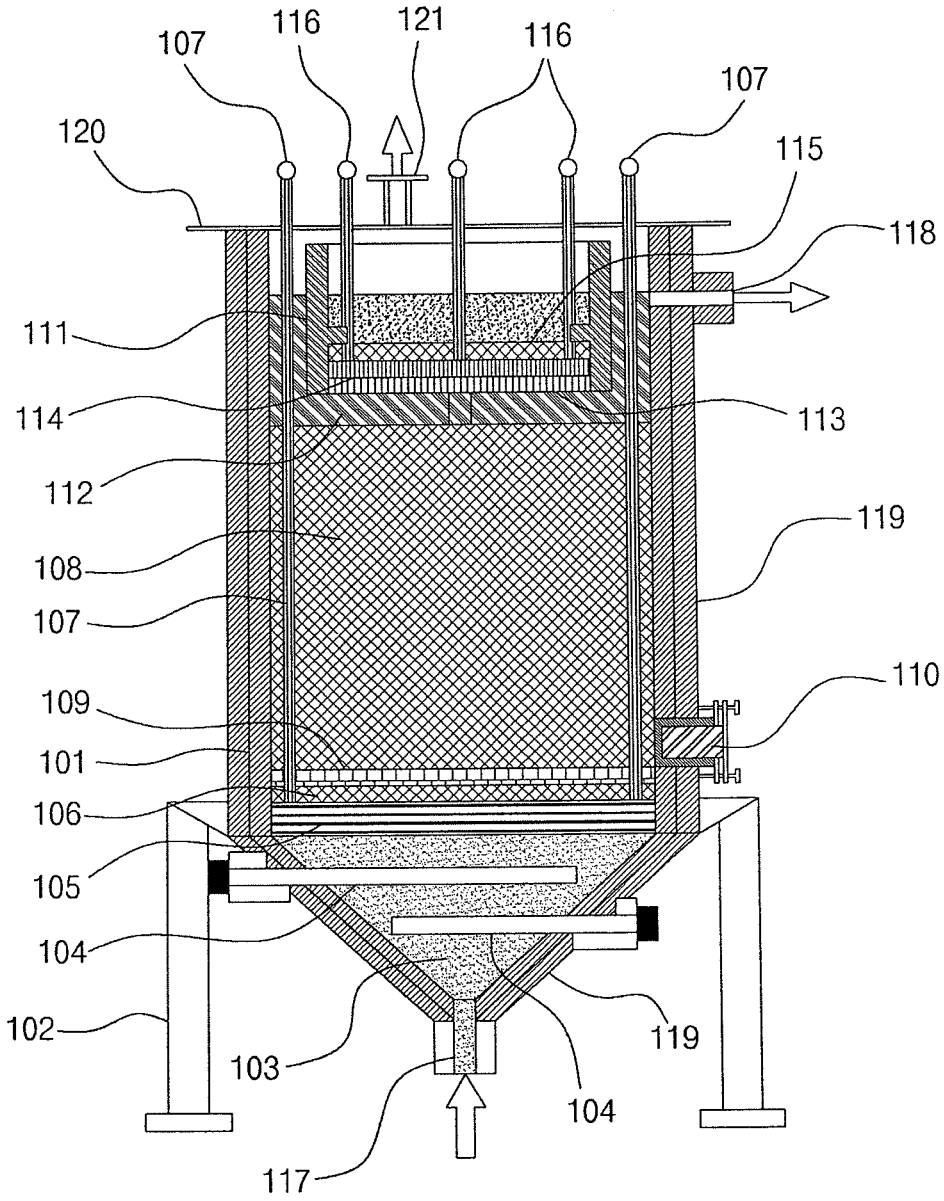
FIG. 3 is a cross-sectional view of a vertical electrolytic cell according to the present invention.

FIG. 3 shows a cross-sectional view of the electrolytic cell according to the present invention.

The vertical flow electrolytic cell comprises a vertical cylindrical body 101 of a three-dimensional multipolar electrode including regenerated catalyst granules and additionally comprises a distributor 103 for distributing electrolyte flow, wherein the distributor is provided with an electric heater 104 for maintaining a predetermined solution temperature. Herein, the circulation direction of the electrolyte flow facing upward has the same axis as the direction of the electromagnetic field in the space of the electrolytic cell.

As noble metals are leached from a three-dimensional multipolar electrode chamber 108, chlorine formed in a horizontally placed anode 106 is distributed throughout filled granular waste catalysts of dielectric metal oxide nature by the upward flow of the electrolyte. A right-angle outlet 110 is placed on the lower side of the cylindrical body structure of the electrolytic cell, whereby the granular catalysts can be discharged in a simple and rapid manner after the metal leaching process.

The lower end of the outlet 110 is located on the same plane as a protecting/supporting dielectric lattice 109 placed on the anode 106 of the multipolar electrode chamber, whereby labor can be minimized and the granular catalysts can be completely discharged.

A corrosion-resistant dielectric supporting lattice 105, which has mechanical rigidity and is placed between the electrolyte flow distributor 103 and the cylindrical body 101, acts as a barrier for the filled granular catalysts, thereby preventing the granular catalysts of the multipolar electrode of the electrolytic cell (space between the electrodes) from penetrating (flowing out) from the vertical cylindrical body into the conical electrolyte flow distributor 103 (space in the front of the anode).

The anode 106, which is horizontally disposed and made of a titanium lattice, distributes the total flux density of an oxidizer, which is formed in the anode, evenly throughout the multipolar electrode. A protective film for the titanium anode, which is made of iridium dioxide ($IrO_2$), prevents either anodic oxidation (formation of a dielectric layer of titanium dioxide ($TiO_2$)) caused by oxygen-containing acid anions or electrochemical corrosion upon oxidation caused by oxygen-free acid anions.

The protecting/supporting dielectric lattice 109 is placed between the titanium lattice of the anode and the regenerated granular catalyst (three-dimensional multipolar electrode) and made of a material (Teflon) having corrosion resistance, heat resistance and mechanical rigidity. It prevents the coating of the anode made of iridium dioxide ($IrO_2$) from being mechanically destroyed by an abrasive material for the granular catalysts.

A diaphragm (made of polypropylene) 114 that separates the cathode of the electrolytic cell from the three-dimensional multipolar electrode chamber minimizes the precipitation of materials such as aluminum oxide on the cathode surface, such that dissolved metals are more completely removed from the electrolytic cell by the electrolyte flow.

A pair of dielectric supports 113 that are horizontally placed between the anode chamber of the electrolytic cell and the three-dimensional multipolar electrode including the regenerated granular catalysts fixes the interval between the anode and the cathode, allows an electromagnetic field to be distributed evenly in the three-dimensional multipolar electrode, and maintains the anode chamber in the upper portion of the cylindrical space of the electrolytic cell.

Because an electric current is applied to the horizontally placed anode 106 through metal bars 107 that perforate the multipolar electrode chamber, the sealing of the electrolytic cell is guaranteed and the electrical safety and convenience of use of the electrolytic cell are improved.

The center of the conical flow distributor 103 is provided with an inlet 117, such that the leached electrolyte is supplied directly to a heat source. The upward thermal convention of the electrolyte flow forms a thermal cushion in a space close to the anode in a state in which the flow rate is not high, thereby preventing the cold electrolyte from penetrating into the cylindrical chamber 108 of the three-dimensional multipolar electrode including the regenerated granular catalysts.

An overflow outlet 118 placed in the upper portion of the cylindrical cathode 111 of the vertical flow electrolytic cell discharges a noble metal salt solution and determines the maximum amount of the electrolyte in the electrolytic cell to prevent the electrolyte from overflowing.

An insulation material 119 surrounding the cylindrical and conical portions of the electrolytic cell minimizes heat loss and reduces energy consumption when carrying out the electrochemical leaching process.

An electrolytic cell lid 120 having a temperature lower than the vapor temperature of the acidic electrolyte allows vapor to be condensed on the inner surface thereof. This reduces electrolyte loss and heat loss and increases the environmental safety of the electrochemical leaching process.

An outlet 121 placed at the electrolytic cell lid 120 removes hydrogen formed in the cathode and prevents hydrogen from being accumulated in the body of the electrolytic cell not filled with the electrolyte, thereby improving the operational stability of the electrolytic cell.

The electrolytic cell comprises a cylindrical body 101, which is placed on a support 102 and connected to the conical flow distributor 103 (space in the front of the anode). The conical flow distributor 103 is provided with an electric hater 104. The cylindrical body is divided from a corrosion-resistant dielectric supporting lattice 105 having mechanical rigidity. On the supporting lattice 105 is placed the anode 106 made of a titanium lattice that is protective-coated with iridium dioxide ($IrO_2$). An electric current is applied to the anode through the metal bars 107 that perforate the multipolar electrode chamber 108. On the anode 106 is placed the supporting/supporting dielectric lattice 109 made of a material (e.g., Teflon) having corrosion resistance, heat resistance and mechanical rigidity. The lower portion of the cylindrical multipolar electrode chamber structure of the electrolytic cell is provided with an outlet 110 for discharging the granular catalysts, and the lower end of the outlet 110 is placed on the same plane as the protecting/supporting dielectric lattice 109 on the anode. The cathode space block 111 placed in the upper cylindrical portion of the vertical flow electrolytic cell is placed on a pair of dielectric supports that are horizontally placed between the cathode chamber of the electrolytic cell and the three-dimensional porous electrode including the regenerated granular catalysts. The cathode body is made of a cylindrical dielectric material. The bottom of the cylindrical body consists of a porous bottom 113 on which a porous diaphragm 114 is placed. On the diaphragm is provided a titanium cathode 115 to which an electric current is supplied through metal bars 116. The electrolytic cell includes an inlet 117 for introducing a leaching electrolyte, an outlet 118 for discharging a noble metal salt solution, and a thin dielectric lid 120 including an outlet 121 for discharging gas.

EXAMPLE

Example 1

Example of Operation of Vertical Electrolytic Cell

In order to leach a noble metal-containing inorganic (metal oxide) dielectric granular waste catalyst (e.g., a 0.02-0.03% palladium-alumina catalyst), the catalyst is introduced through the top of the cylindrical portion 101 of the electrolytic cell. Before the catalyst is introduced, the cathode compartment 111 is dissembled from the electrolytic cell. A leaching electrolyte (e.g., 3% HCl aqueous solution) is introduced into the conical flow distributor 103 through the lower inlet 117, and the inside of the distributor is heated to a predetermined temperature by the electric heater 104. The heated electrolyte laminar flow passes through the dielectric supporting lattice cell 105, is oxidized in the horizontal anode lattice 106, and passes through the porous protecting/supporting lattice 109 to the three-dimensional porous electrode including the regenerated granular catalyst. The noble metal is leached from the granules into the electrolyte solution in the form of a salt during the process in which the oxidized electrolyte solution passes through the granular catalyst bed. This leaching process occurs when overvoltage is significantly decreases as a result of a decrease in electric current density, because the working area of the three-dimensional multipolar electrode is large. After the noble metal salt solution has been discharged from the granular waste catalyst bed, it is discharged from the vertical flow electrolytic cell body through the overflow outlet 118. The cathode space is filled with the electrolyte through the porous diaphragm when the electrolytic cell is first filled with the electrolyte. The diaphragm controls the movement of the noble metal ions to the cathode space, thereby reducing the amount of noble metal ions that precipitate in the cathode. The electrolyte that evaporates is condensed on the cold wall of the thin lid 120 of the electrolytic cell, and hydrogen that is separated from the cathode is removed through the outlet 121 from the space of the cylindrical portion of the electrolytic cell, which is not filled with the electrolyte. After completion of the leaching process, the electrolyte is discharged through the lower outlet 118, and the granular catalyst is discharged through the outlet 110.

After carrying out the above Example, the granular catalyst was examined. As a result, it was found that the amount of platinum-group metal remaining on the granular catalyst after subjected to electrochemical leaching was not more than 1 ppm in the lower portion of the electrolytic cell and 1-10 ppm in the upper portion.

The invention claimed is:

1. A vertical flow electrolytic cell for electrochemically leaching out platinum-group metals from granular catalysts containing the platinum-group metals, the electrolytic cell comprising:

(a) an electrolyte flow distributor having an electrolyte inlet; and (b) a cylindrical body positioned above and in fluid communication with the electrolyte flow distributor for the receipt of electrolyte, said body having a granular catalyst outlet and an electrolyte overflow outlet and further comprising (1) an anode which is horizontally disposed above and in fluid communication with the electrolyte flow distributor for the receipt of electrolyte, (2) a multipolar electrode chamber which has an interior zone for catalyst loading and which is positioned concentrically above and adapted to receive electrolyte from the anode, (3) a cathode containing chamber which is filled with activated carbon granules and which is positioned concentrically above, and adapted to receive electrolyte from, the multipolar electrode chamber, said cathode containing chamber containing a charging block for coupling to a source of electrical power, and (4) a plurality of electrical conductors which extend vertically from the cathode containing chamber, through the multipolar chamber and to the anode;

wherein, upon loading of platinum group metal-containing granular catalysts in the multipolar electrode chamber and application of an electrical potential difference between the cathode containing chamber and anode by charging of the cathode, upward electrolyte flow through the anode, multipolar electrode chamber and cathode-containing chamber results in simultaneous electrochemical leaching and chemical sorption of platinum-group metals contained in the granular catalysts.

2. The vertical flow electrolytic cell of claim 1, wherein the electrolyte flow distributor further comprises at least one heat source.

3. The vertical flow electrolytic cell of claim 2, wherein the granular catalyst outlet is located on the lower outer surface of the multipolar electrode chamber.

4. The vertical flow electrolytic cell of claim 2, wherein the electrolyte overflow outlet is located above the multipolar electrode chamber.

5. The vertical flow electrolytic cell of claim 1, further comprising a corrosion-resistant dielectric lattice affixed to the anode.

6. The vertical flow electrolytic cell of claim 5, further comprising at least one of a porous diaphragm and a porous cathode compartment support affixed to the cathode.

7. The vertical flow electrolytic cell of claim 1, further comprising a support member affixed to en the bottom portion of the multipolar electrode chamber.

8. The vertical flow electrolytic cell of claim 1, further comprising a thin dielectric lid positioned above and affixed to the cathode chamber.

9. The vertical flow electrolytic cell of claim 8, further comprising an outlet for separated gas located on the thin dielectric lid.

10. The vertical flow electrolytic cell of claim 1, wherein the anode is made of a titanium lattice.

11. The vertical flow electrolytic cell of claim 1, wherein the anode is coated with iridium dioxide ($IrO_2$).

12. The vertical flow electrolytic cell of claim 1, wherein the electric conductors comprise a metal bar.

13. The vertical flow electrolytic cell of claim 1, wherein the outer surfaces of each of the electrolyte flow distributor and the cylindrical body are insulated.

14. An electrolytic cell for removing platinum group metals from granular catalysts, said electrolytic cell comprising:

(a) a cathode containing chamber which is filled with activated carbon granules and which is in fluid communication with means for receipt and discharge of an electrolyte, said cathode containing chamber comprising means for coupling to a source of electrical power;

(b) a multipolar electrode chamber positioned beneath and in fluid communication with the cathode containing chamber for the transmission of electrolyte, said multipolar electrode chamber having an interior zone for catalyst loading;

(c) a horizontally disposed anode which is positioned beneath and in fluid communication with the multipolar electrode chamber for the transmission of electrolyte;

(d) an electrolyte distributor positioned beneath and in fluid communication with the anode for the transmission of electrolyte, said electrolyte distributor having means for receiving an electrolyte and means for heating electrolyte fed to the anode; and (e) a plurality of electrical conductors which extend vertically from the cathode containing chamber, through the multipolar chamber and to the anode;

wherein, upon loading of platinum group metal-containing granular catalysts in the multipolar electrode chamber and application of an electrical potential difference between the cathode containing chamber and anode by charging of the cathode containing chamber, upward electrolyte flow through the anode, multipolar electrode chamber and cathode-containing chamber results in simultaneous electrochemical leaching and chemical sorption of platinum-group metals contained in the granular catalysts.

15. The electrolytic cell of claim 14, wherein the electrical conductors are a plurality of conductive wires or bars.

16. The electrolytic cell of claim 14 or 15, wherein dielectric supports are horizontally disposed between and separate the multipolar electrode chamber and cathode containing chamber.

17. A system for removing platinum group metals from granular catalysts, said system comprising:

(a) an electrolytic cell of claim 14, 15 or 16; and (b) means for recirculation of electrolyte from the cathode containing chamber to the electrolyte distributor.

18. The system of claim 17, wherein the means for recirculation of electrolyte comprise a pump under the control of a flow controller.

19. A process for removing platinum group metals from granular catalysts, said process comprising the steps of:

(a) loading platinum group metal-containing granular catalysts into an electrolytic cell, said electrolytic cell comprising:

(1) a cathode containing chamber which is filled with activated carbon granules and which is in fluid communication with means for receipt and discharge of an electrolyte, said cathode containing chamber comprising means for coupling to a source of electrical power;

(2) a multipolar electrode chamber positioned beneath and in fluid communication with the cathode containing chamber for the transmission of electrolyte, said multipolar electrode chamber having an interior zone for catalyst loading;

(3) a horizontally disposed anode which is positioned beneath and in fluid communication with the multipolar electrode chamber for the transmission of electrolyte;

(4) an electrolyte distributor positioned beneath and in fluid communication with the anode for the transmission of electrolyte, said electrolyte distributor having means for receiving an electrolyte and means for heating electrolyte fed to the anode; and (5) a plurality of electrical conductors which extend vertically from the cathode containing chamber, through the multipolar chamber and to the anode; and (b) (1) feeding electrolyte to the electrolyte distributor, heating the electrolyte fed to the electrolyte distributor and transmitting heated electrolyte from the electrolyte distributor to the anode, multipolar electrode chamber and cathode containing chamber, and (2) applying an electrical potential difference between the cathode containing chamber and anode by charging the cathode containing chamber;

wherein upward electrolyte flow through the anode, multipolar electrode chamber and cathode-containing chamber results in simultaneous electrochemical leaching and chemical sorption of platinum group metals contained in the granular catalysts.

20. The process of claim 19, wherein electrolyte is recirculated to the electrolyte distributor.

21. The process of claim 20, wherein electrolyte is recirculated by a pump which is under the control of a flow controller.

22. The process of claim 19, wherein the process further comprises the step of maintaining and adjusting as necessary the pH of the electrolyte.

23. The process of claim 20, wherein the process further comprises the step of maintaining and adjusting as necessary the pH of the electrolyte.

24. The process of claim 21, wherein the process further comprises the step of maintaining and adjusting as necessary the pH of the electrolyte.

25. The process of claim 19, wherein the process further comprises the step of discharging treated granular catalysts.

26. The process of claim 20, wherein the process further comprises the step of discharging treated granular catalysts.

27. The process of claim 21, wherein the process further comprises the step of discharging treated granular catalysts.

28. The process of claim 22, wherein the process further comprises the step of discharging treated granular catalysts.

* * * * *